US006540564B1

(12) United States Patent
Ko

(10) Patent No.: US 6,540,564 B1
(45) Date of Patent: Apr. 1, 2003

(54) CONNECTOR ASSEMBLY

(75) Inventor: David Tso-Chin Ko, Thousand Oaks, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/075,357

(22) Filed: Feb. 13, 2002

(51) Int. Cl.[7] ..... H01R 24/00
(52) U.S. Cl. ..... 439/676; 439/541.5; 439/489
(58) Field of Search ..... 439/676, 541.5, 439/79, 607, 903, 489

(56) References Cited

U.S. PATENT DOCUMENTS 5,989,069 A * 11/1999 Tan ..... 439/620
6,080,011 A * 6/2000 Tsao et al. ..... 439/541.5
6,319,047 B1 * 11/2001 Kang ..... 439/404
6,350,158 B1 * 2/2002 Arnett et al. ..... 439/676
6,471,551 B2 * 10/2002 Morana et al. ..... 439/676

* cited by examiner

*Primary Examiner*—Hien Vu
(74) *Attorney, Agent, or Firm*—Wei Te Chung

(57) ABSTRACT

A connector assembly (1) mounted on a printed circuit board for mating with the network cable includes a housing (11) configured to two mating ports (10) to receive their complementary connector. A conditioning unit (3) is installed into the housing (11) and disposed between these mating ports (10), and includes a circuit board (30) having conditioning components (31) and two terminal modules (32) surface mounted thereon. A pair of flexible latching portions (14) is formed on two side edges of the rear side of the housing (11) respectively. And a stopping portion (16) is formed underneath every latching portion (14) and extending a predetermined distance longer than the length of the latching portion. A notch (37) is formed at one edge of the circuit board (30) to be engaged with the latch (14) to fix the conditioning unit (3) in position. The latching portion (14) is easily detached from the notch (37) of the circuit board (30) by a tool to simply any rework or repair process while the stopping portion (16) will restrict and protect the flexible latching portion (14) from being overstressed or over-bending.

8 Claims, 5 Drawing Sheets

CONNECTOR ASSEMBLY

CROSS REFERENCE TO RELATED APPLICATIONS

This application is related to U.S. patent application Ser. No. 10/036073, entitled "Connector Assembly", filed on Oct. 19, 2001. The disclosure of the above identified application are incorporated herein by reference.

BACKGROUND OF THE INVENTION

1. Field of the Invention

The present invention is related to a connector assembly of stacked modular jacks, especially to a connector assembly having a conditioning unit including a circuit board with magnetic conditioning components mounted on it to condition the signals passing through the connector assembly.

2. Description of the Related Art

The signal transmission speed in a network depends on the conductivity of the cables, the operation speed of the workstations or servers signals transmitting, and the condition of the environment in which computers and cables located. Usually the signals transmitted by cables are easily affected because of the diversity and unpredictability of the environment cables meet. The best way to avoid any noise interference is shielding the cable and device all the time. However, in high frequency and speed situation, any necessary connection is always a deficiency to cause signal interfered by the outer noise for perfect transmission. And the cost for a perfect electrical shield is expensive too. Besides, crosstalk always happens between two parallel signal-transmitting conductors. Thus, the signals transmitted by cables or wires should be conditioned first before they are used in any electrical device like computers. Especially, to dispose a conditioning component, such as a common mode choke coil, filter circuit or transformer, into the I/O connector of these devices is a good way because the I/O connector is always the last or important part of the necessary connections should be well shielded for a perfect transmission. Sakamoto et al. U.S. Pat. No. 5,139,442 introduces such a modular jack connector having a built-in common-mode choke coil. However, to use wires of the coil as contactors of the modular jack connector causes more complicated assembling process costing high and being time-consuming. Therefore U.S. Pat. No. 5,687,233 issued to Loudermilk et al. discloses a built-in modularized printed circuit board containing a noise suppressing electronic element like transformer is received in the modular jack connector. It is obviously laborsaving because the contactors of the connector are mounted to the printed circuit board after the filter circuit and related electronic elements are mounted onto the printed board in advance. The method adopted in Loudermilk et al. needs to be improved due to its still complicated process to assemble the printed board and the connector housing. Especially the isolated contactors of the connector should be well sustained when assembled into the connector housing together with the printed board. And in the multi-port application, the increasing contactors needed to be mounted onto the motherboard will make it much more difficult to dispose or assemble the built-in printed board. U.S. Pat. No. 5,587,884 discloses a subassembly inserted into the housing of the modular jack connector. The subassembly includes a front insert member having contact terminals and a rear insert member having a printed board with conditioning components mounted thereon. Better support from these two insert members will effectively sustain the terminals and other components when the subassembly is inserted into the connector housing and fasten the assembling process. However, much more procedures are needed to manufacture the subassembly and most of them like insert-molding cost expensively. Besides, new parts are needed in the multi-port application. Minich U.S. Pat. No. 6,022,245 shows a modular connector having two stack plug receiving ports. Two retainers hold terminals in the connector housing and a printed board has filter components and an edge connector connecting the printed board to the motherboard where the modular connector is seated. After the retainers and terminals are properly installed into the housing, the printed circuit board is installed into the housing and ends of terminals is resiliently engaged onto the printed board. Installing support to every terminal is enough again and simplifying process will be adopted to produce each of necessary parts. However, in this case, too many parts are needed and the assembling process is still complicated and labor consuming. And more fixture mechanism in the housing is needed to put each of these parts in position.

Furthermore, Morana et al. U.S. Pat. No. 6,193,560 shows a connector assembly has rows of terminal arrays each row having a common dielectric carrier. The carriers are installed one behind the other with guide sections disposed thereon being guided along common guides of the housing. And the housing has a resilient latch arm that extends between the terminal arrays to hold the carriers one behind the other. The way to assemble similar modularized terminal carriers into the connector is not too complicating. However, the retention of the resilient latch arm is not good enough to hold the dielectric carriers in the housing because the resilient latch arm are easily touchable and may be yielded or damaged in the future without any protection. This causes unreliable connection of the terminal carriers and this connector while reworking is needed to repair parts of the connector.

In conclusion, it is understandable that most of methods adopted by these prior arts mentioned above have a complicated process, especially when assembling. Meanwhile, it is difficult to hold parts reliably in position again after some of them are dismantled and fixed. Some of parts disclosed in prior art are vulnerable when removing from the housing. That means it is better not to rework or repair on them even though some of them need to change.

SUMMARY OF THE INVENTION

Therefore, an object of the present invention is to provide a connector assembly which has simplified parts to assemble to each other and these parts are detachable easily under reliable situation.

Another object of the present invention is to provide a connector assembly with parts that are releasable using the flexible retention means being well protected from easy access, yielding due to long term use or failure caused by the unexpectedly broken.

To obtain the above objects, a connector assembly including a housing configured to two mating ports to receive their complementary connector is formed. A conditioning unit is installed into the housing and disposed between the mating ports. The conditioning unit includes a circuit board having conditioning components and two terminal modules surface mounted thereon. Each of the terminal modules has terminals insert-molded therein and is mounted on one side of the circuit board to make one end of terminals exposed into the corresponding mating port separately.

Specifically, a pair of flexible latching portions is formed on two side edges of the rear side of the housing respectively. And a stopping portion is formed underneath every latching portion and extending a predetermined distance longer than the length of the latching portion. At one edge of the circuit board, a notch is formed corresponding to the latching portion of the housing. When assembling, the conditioning unit is inserted into the housing and the edge of the circuit board snug in a guiding groove formed on the inward side of the sidewall and the latching portion is then engaged with its corresponding notch to fix the unit in position. For such an arrangement, the conditional unit is easily secured to the housing and finally settled between two mating port to ease the assembly of two terminal modules for each mating port. And the latching portion is easily detached from the notch of the circuit board by a tool to simply any rework or repair process while the stopping portion will restrict and protect the flexible latching portion from being overstressed or over-bending.

Other objects, advantages and novel features of the invention will become more apparent from the following detailed description of the present embodiment when taken in conjunction with the accompanying drawings.

DESCRIPTION OF THE PREFERRED EMBODIMENT

Figure 1:
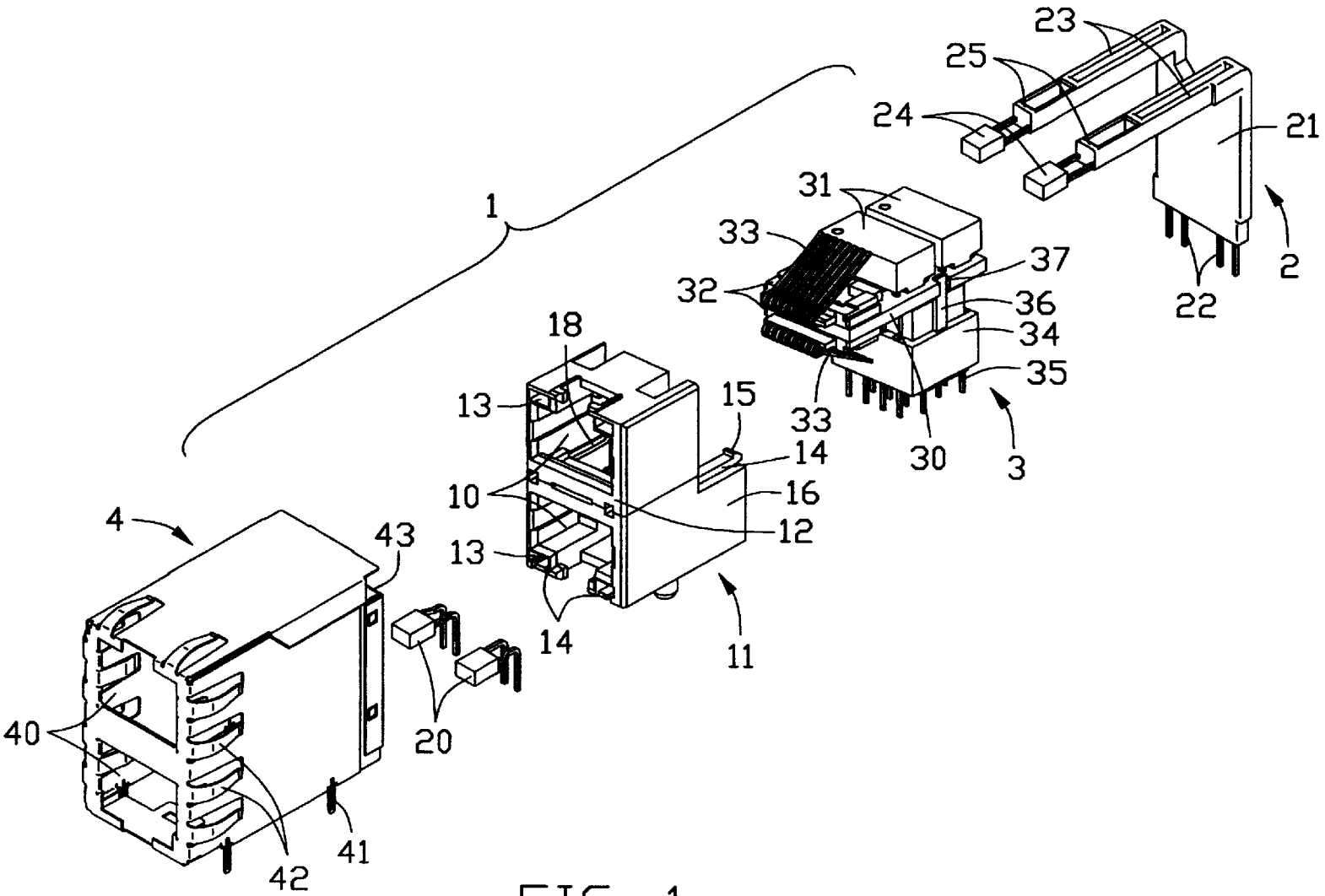
FIG. 1 is an exploded view of a connector assembly in accordance with the present invention.
Figure 2:
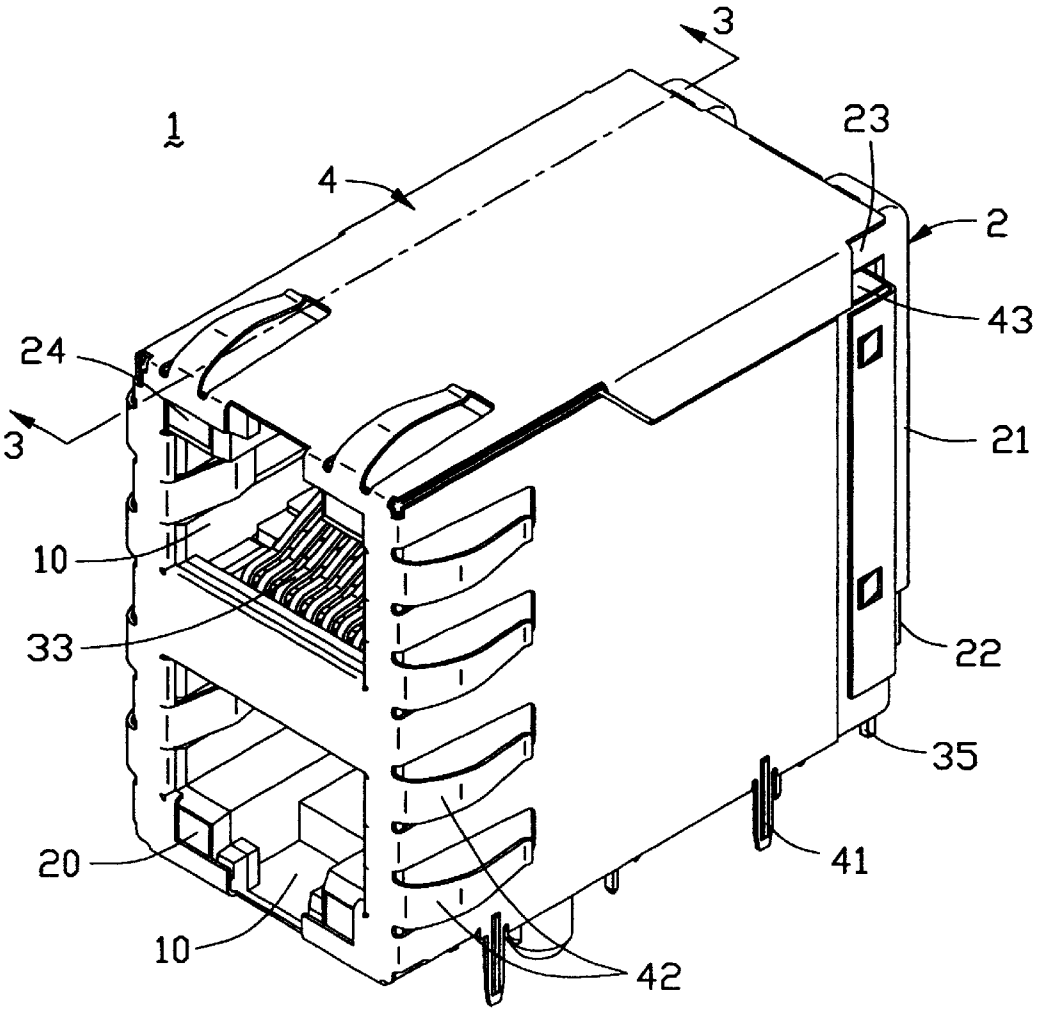
FIG. 2 is an assembled perspective view of the connector assembly of the present invention.

Referring to FIGS. 1 and 2, the present invention is related to a connector assembly 1 and is shown that includes at least two stacked and mirror-arranged modular jack mating ports 10 each being used to connect to a network cable (not shown) and transmitting signals between the cables and a printed circuit board (PCB, not shown) where the connector assembly 1 is seated and mounted. A housing 11 is configured to provide these two mating ports and forms two vertically arranged spaces to receive the corresponding mating plugs of the network cables. At the front wall 12 of the housing 1, four holes 13 are disposed at each comer of the front wall 12. Each of two lower holes 13, near the PCB mounting side of the front wall 12, goes deep into the housing 11 from the front wall 12 for a predetermined depth to receive a standard single LED 20 therein. Each LED 20 is inserted into the corresponding lower hole 13 by first having its right-angled legs crossing and moving along slits 13' formed on the bottom sidewall of every lower hole 13. Each of two upper holes 13 disposed away from the PCB is perforated into the housing 11 from the front wall 12 of the housing 11 to the rear side of the housing 11. A pair of flexible latching portions 14 is formed on two side edges of the rear side of the housing 11 and each extends rearwards from the middle portion of one side edge for a predetermined length. A bump 15 is protruded upwards at the distal end of every latching portion 14. And a stopping portion 16 is disposed on the lower portion of every side edge and extends rearwards parallel and next to one of the pair of latching portions 14 for a predetermined distance a little longer than the length of every latching portion 14. While each latching portion 14 is forced bending downwards, the subjacent stopping portion 16 next to the latching portion 14 will block the further movement of the latching portion 14 once the distal end of the latching portion 14 abuts against the upper surface of the stopping portion 16.

Figure 3:
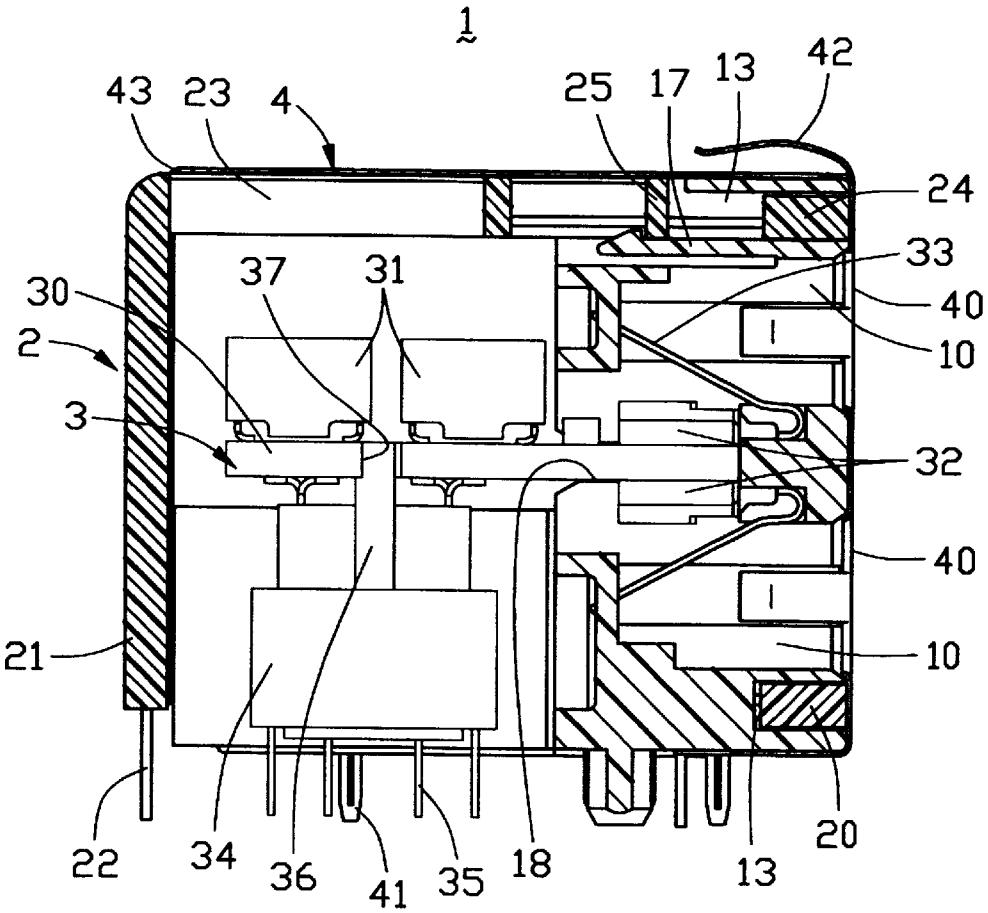
FIG. 3 is a sectional view of the connector assembly showing a conditioning unit including surface mount filter components and terminal modules along the 3—3 line in FIG. 2.
Figure 5:
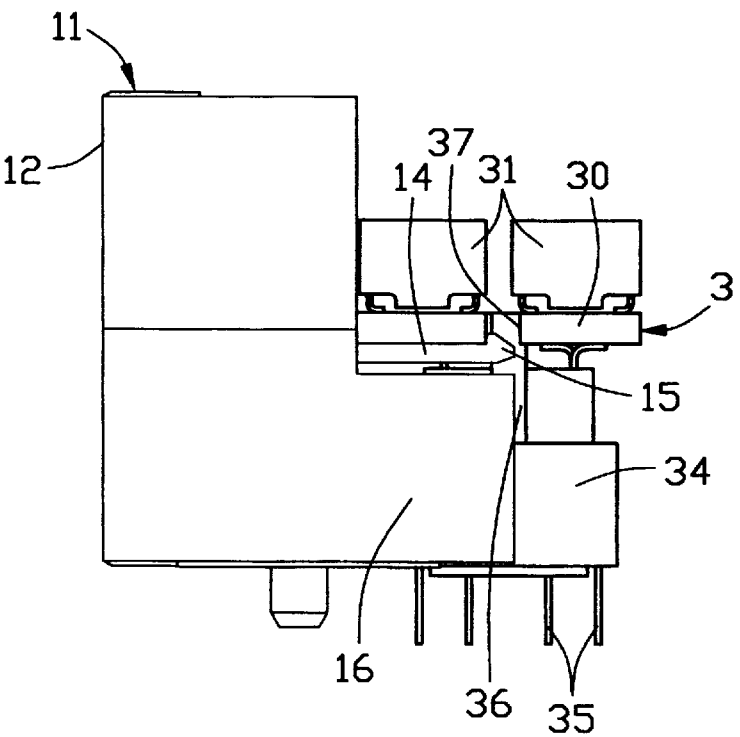
FIG. 5 is a side view of a subassembly of the housing and conditioning unit while the outer shell is dismantling off.
Figure 4:
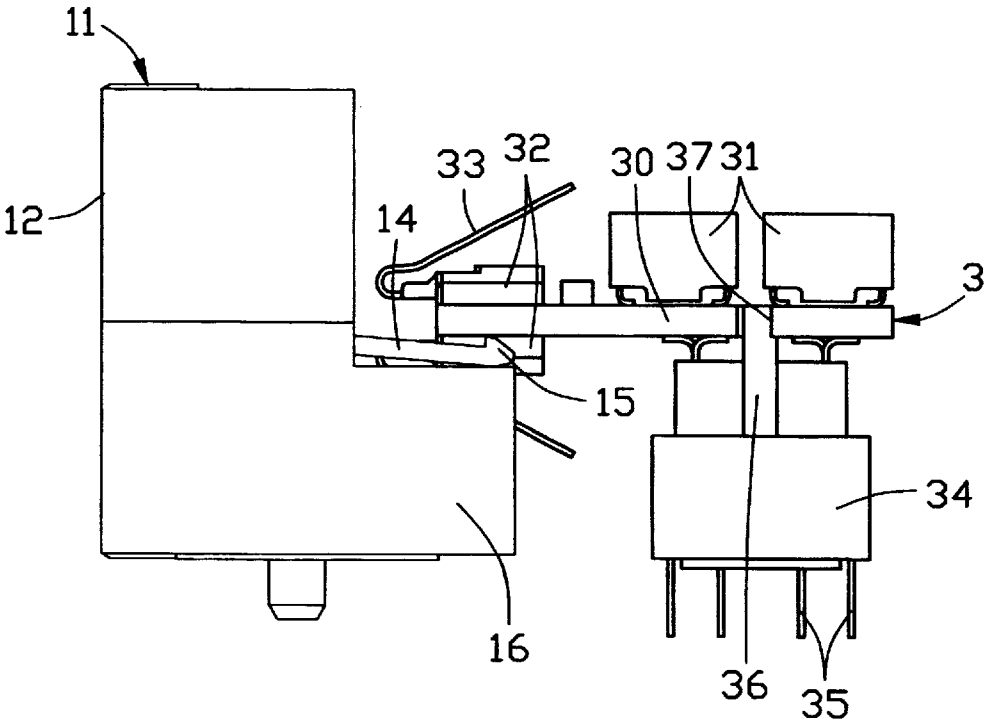
FIG. 4 is a side view of the housing and conditioning unit while the conditioning unit is installed into the housing.

Referring to FIGS. 1 and 3, a conditioning unit 3 is installed into the housing 11 and located in a plane defined perpendicular to the front wall 12 of the housing 11. The conditioning unit 3 includes a circuit board 30 with conductive traces (not shown) on it. At least two sets of magnetic filtering/conditioning components 31 corresponding to the mating ports 10 are surface mounted on the upper surface of the circuit board 30 to condition the signals passing through them. Two sets of terminals 33 are respectively insert-molded into an upper and lower terminal module 32 respectively and are separately surface mounted on the upper and lower surface of the circuit board 30 near a leading edge (not labeled) thereof. A tail module 34 has two sets of tail conductors 35 and each set is corresponding to one of the terminal modules 32. The tail module 34 is surface mounted on the lower surface of the circuit board 30. One end of every tail conductors 35 is surface mounted on the circuit board 30 and the other end is used to connect to the PCB where the connector assembly 1 is seated. Besides, two notches 37 each is formed on two opposite side edges of the circuit board 30 adjacent to the leading one of the circuit board 30 and is disposed corresponding to the bump 15 of every latching portion 14 of the housing 11. Two arms 36 extending from two opposite sides of the tail module 34 each has its end inserted into one of the notch 37 to position the tail module 34 before the tail conductors 35 are surface mounted onto the circuit board 30.

A LED module 2 having two standard LEDs insert-molded integrally therein is installed into the connector assembly 1 from the rear side of the housing 11. The LED module 2 has a base portion 21 with legs 22 of LEDs extending therein and two branch portions 23 right-angled extend from the top edge of the base portion 21 respectively. At the end of each branch portion 23 a light-emitting body 24 of every LED is disposed. Ribs 25 are formed on the middle section of every branch portion 23. Every branch portion of the LED module 2 is received in one of the upper holes 13 when assembling and the light-emitting body 24 of every LED is then visible from the front side of the housing 11. In addition, an outer shell 4 is disposed to cover the housing 11. Two mirror-shaped hollows 40 corresponding to the mating ports 10 are formed on the front plate 47 of the outer shell 4 and a plurality of fingers 42 cut from the portions of the top plate 48 and two opposite side plates 49, are bent curvedly away from the corresponding top and side plates 48, 49 and each extends rearward from edges of the front plate 47. Legs 41, usually grounded, are formed on the bottom edges of two side plates. The rear plate, as an extending portion of the top plate before assembling, is bent downward after the housing 12 is positioned in a space formed inside the outer shell 4 and engaged with two side plates at their adjacent edges. Two recesses 43 on the rear plate are formed abutting the top plate and each is aligned with one of the upper holes 13 after assembling.

Referring particularly to FIGS. 1, 3 to 5, the conditioning unit 3, when assembling, is first inserted into the housing 11 from its rear side by having two opposite side edges of the circuit board 30 snug in guiding grooves 18 formed on two opposite inner sidewalls of the housing 1 land pushing the whole unit 3 sliding into the housing 11. Each of the latching portions 14 of the housing 11 is first pressed bending downward by the leading edge of the circuit board 30 due to the upward protruded bump 15 formed at its distal end and then engaged with the corresponding notch 37 formed on the side edges of the circuit board 30 via its bump 15 to fix the unit 3 in position when the leading edge of the circuit board 30 reaches to the rearward side of the front wall 12. After the LEDs 20 are snug within the lower hole 13 of the housing 11, the housing 11 is then enclosed by the outer shell 4. The branch portions 23 of the LED module 2 are then penetrated into the recesses 43 of the outer shell 4 and a flexible locking arm 17 formed on the bottom sidewall of every upper hole 13 is used to lock the LED module 2 on the rib 25 of its branch portion 23. It is understandable that, when assembling, the bending latching portion 14 of the housing 11 is easily blocked by the stopping portion 16 because the gap formed between the latching portion 14 and the upper surface of the stopping portion 16 is approximately equal to the protrusion height of the bump 15 of the latching portion 14. Therefore, the latching portions 14 are effectively protected by the stopping portion 16 from being overstressed, over-bending or easily touchable for much reliable assembling due to the limited gap space between the assembled circuit board 30 and the stopping portion 16.

Figure 6:
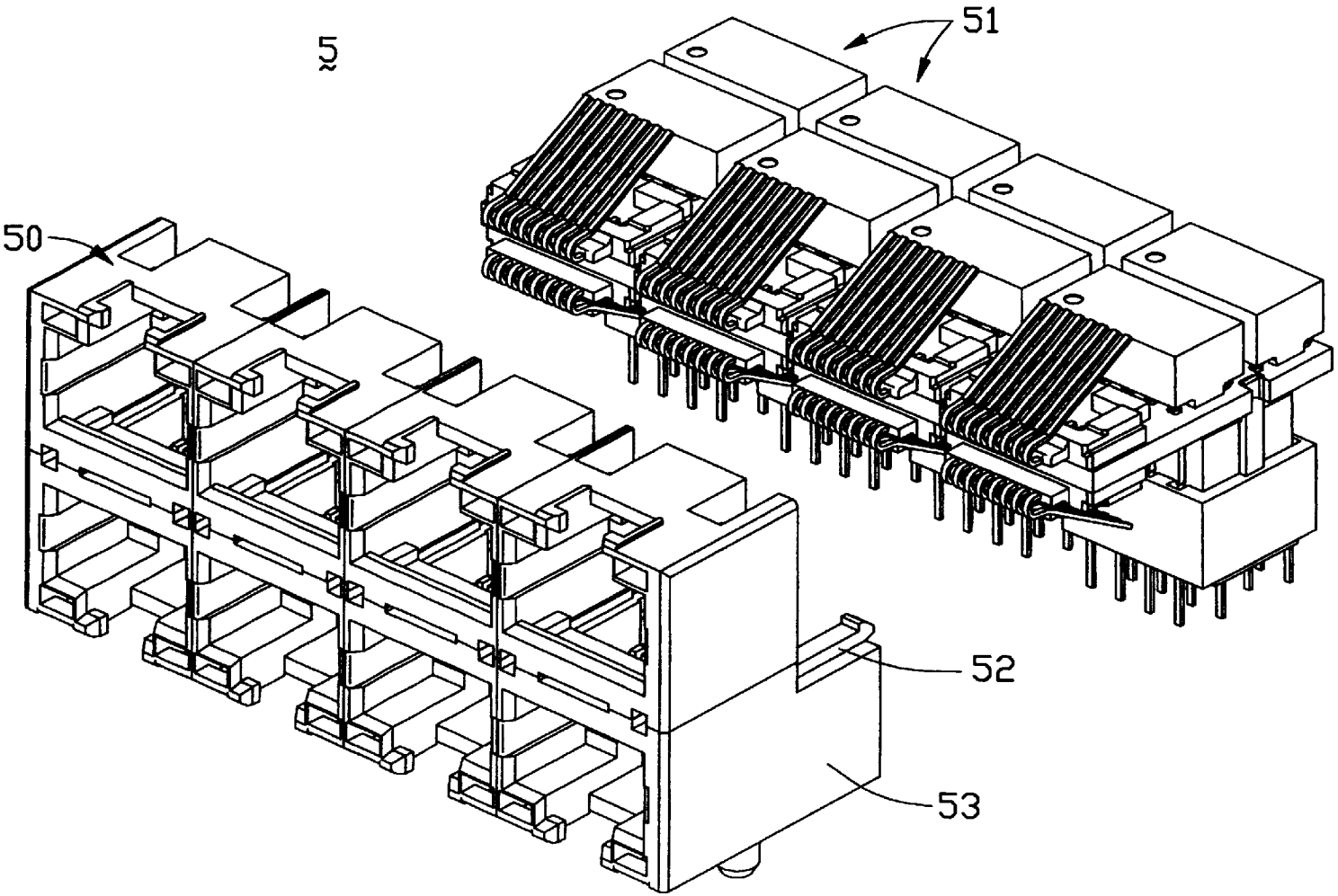
FIG. 6 is an exploded view of a multi-port connector assembly in accordance with the present invention while the outer shell is dismantling off.

Referring to FIG. 6, an unshielded subassembly 5 of a connector assembly with multi mating ports is shown. An integral unshielded housing 50 is formed to put all ports together in two-rowed side-by-side arrangement. A plurality of conditioning units 51 each having the same mechanism as mentioned above is inserted into the housing 50 respectively. A pair of flexible latching portions 52 is formed on the middle portion of the sidewall of every mating port and used to fix one of the conditioning unit 51 respectively. A corresponding stopping portion is formed next to every latching portion 52 for the same protective reason. Effective cost-down will take place by sharing the same parts like conditioning units 51 to make different optional jack assembly. And fast and easily assembling process for this multi-port connector assembly helps conveniently parts removing too. It is understandable, meanwhile, in either assembling or reworking process the latching portions 52 are protected by their neighboring stopping portion 53 for long-term use.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector assembly comprising:

a housing adapted to be seated on a printed circuit board defining at least one mating port for receiving a complementary connector;

a unit having a conditioning component thereon and being disposed into the housing and positioned beside the mating port and a plurality of terminals being mounted thereon to electrically connect the printed circuit board with the complementary connector; and a flexible latching portion formed in the housing being deflectable from a first position, where said unit is interferentially assembled to the housing with the latching portion, to a second position where said unit is assembled into the housing in position without interference with the latching portion, a stopping portion being formed in the housing next to the second position and used to restrict the movement of the latching portion within a predetermined extent; wherein the latching portion extends from the rear side of the housing and along one edge of said unit; wherein the stopping portion extends from the rear side of the housing underneath the latching portion and a gap is formed between the stopping and latching portion when the latching portion is in the first position; wherein said unit includes a circuit board using to have the conditioning component mounted thereon, and said circuit board further comprises a notch formed on one edge of the circuit board to make the latching portion engaging therewith when said unit moves in the housing.

2. The connector assembly as recited in claim 1, wherein at least one guiding groove is formed on an inner wall of the housing to help positioning said unit with respect to the latching portion.

3. The connector assembly as recited in claim 1, wherein the connector assembly comprises even mating ports and every two thereof are stacked in the normal direction of the printed circuit board, and said unit is disposed between said two mating ports and two sets of said terminals are received in said two mating ports respectively.

4. The connector assembly as recited in claim 1, wherein a tail module is used to connect said unit to the printed circuit board.

5. The connector assembly as recited in claim 1, wherein the connector assembly further comprises an outer shell used to enclose the housing.

6. The connector assembly as recited in claim 1, wherein the connector assembly further comprises an LED module having at least one LED insert-molded therein and used to as a visible indicator of the mating port.

7. A connector assembly comprising:

a housing defining at least one mating port for receiving a complementary connector and being mounted on a printed circuit board where the connector assembly is seated;

a unit having at least one conditioning component mounted thereon and being installed in the housing, said unit having terminals mounted thereon to electrically connect the printed circuit board to the complementary connector; wherein at least one latching portion is formed in the housing to latch deflectively said unit and secure said unit within the housing, and a stopping mechanism is formed to restrict the movement of the latching portion in a predetermined range whereby the latching portion is able to releasably latch said unit; wherein the latching portion extends from the rear side of the housing and along one edge of said unit; wherein at least one guiding groove is formed on an inner wall of the housing to help positioning said unit with respect to the latching portion; wherein the stopping portion extends from the rear side of the housing underneath the latching portion and a gap is formed between the stopping and latching portion when the latching portion is not deflected; wherein said unit includes a circuit board to have the conditioning component mounted thereon, said circuit board further comprises a notch formed on one edge of the circuit board to make the latching portion engaged therewith when the edge of said unit pass through the latching portion.

8. The connector assembly as recited in claim 7, wherein the connector assembly comprises even mating ports and said unit is disposed between every two mating ports and two sets of said terminals are received in said every two mating ports respectively.

* * * * *